United States Patent [19]

Brittain

[11] Patent Number: 4,586,520

[45] Date of Patent: May 6, 1986

[54] MASCARA APPLICATOR

[75] Inventor: David C. Brittain, Memphis, Tenn.

[73] Assignee: Plough, Inc., Memphis, Tenn.

[21] Appl. No.: 548,114

[22] Filed: Nov. 2, 1983

[51] Int. Cl.[4] ..... A45D 40/25

[52] U.S. Cl. ..... 132/88.7

[58] Field of Search ..... 132/88.5, 88.7, 85; 401/129, 122

[56] References Cited

U.S. PATENT DOCUMENTS

| | | | |
|---|---|---|---|
| D. 249,401 | 9/1978 | Glasberg | D4/31 |
| 2,007,245 | 7/1935 | Gimonet | 128/260 |
| 2,622,259 | 12/1952 | Chauvin | 15/167 |
| 2,672,875 | 3/1954 | Kovacs | 132/13 |
| 2,754,531 | 7/1956 | Rowland | 15/183 |
| 2,798,726 | 4/1961 | Park | 15/183 |
| 3,084,374 | 4/1963 | Ziegler | 401/122 |
| 3,147,757 | 9/1964 | Nofmann | 132/114 |
| 3,343,551 | 9/1967 | Anderson | 132/88.7 |
| 3,363,635 | 1/1968 | Wurmbock | 132/88.7 |
| 3,692,417 | 9/1972 | Aston | 401/129 |
| 3,861,810 | 1/1975 | Vasas | 401/122 |
| 3,930,280 | 1/1976 | Vasas | 15/257.05 |
| 4,165,755 | 8/1979 | Cassai | 132/88.7 |
| 4,268,933 | 5/1981 | Papas | 15/167 R |
| 4,328,604 | 5/1982 | Adams | 15/110 |
| 4,403,624 | 9/1983 | Montgomory | 401/122 |

*Primary Examiner*—Gregory E. McNeill

*Attorney, Agent, or Firm*—Gerald S. Rosen

[57] ABSTRACT

Disclosed is a mascara applicator whose brush contains alternating rows of long and short bristles. The alternating rows of long and short bristles allow for facile application of mascara while simultaneously combing and separating the eyelashes.

6 Claims, 8 Drawing Figures

MASCARA APPLICATOR

FIELD OF THE INVENTION

The present invention pertains to an improved mascara applicator capable of uniformly and evenly applying mascara to eyelashes. Clumping and excess mascara on the eyelashes is avoided. The eyelashes appear naturally thicker and longer without sticking together.

BACKGROUND OF THE INVENTION

During recent years mascara has become an important make-up accessory. Numerous applicators and application systems have been designed to apply mascara for increasing curl, color and length of the eyelashes. However, some applicators do not properly apply the mascara causing a build-up of excessive amounts of mascara on the lashes. This can cause the lashes to stick together, resulting in an unnatural lash appearance. Quite often the eyelashes are merely pushed back and clumped, they are not combed, uniformly coated or separated. As a result, the user may be required to redistribute the mascara and separate the lashes in order to obtain the desired natural lash appearance.

The present invention provides for a mascara applicator which uniformly and evenly applies mascara, while simultaneously separating and combing the eyelashes. The mascara applicator of the present invention employs alternating rows of long and short bristles. The rows of short bristles apply the mascara while the rows of long bristles simultaneously comb and separate the eyelashes.

The present invention can be more formally stated as a mascara applicator for applying fluent mascara, that comprises an elongated shaft having brush and handle portions, and a reservoir for holding a supply of the mascara which is deposited on the brush portion when the brush is dipped therein. The reservoir has an orifice or wiper for metering the mascara deposited on the brush portion. A cooperating cover member which is part of the handle portion removably engages with said reservoir member for closing said orifice opening. The brush contains bristles of which approximately 10–50% are long bristles of about 0.125 inches to 0.350 inches in length and approximately 50–90% are short bristles of about 0.125 inches to 0.185 inches in length. The long bristles are grouped in sets that radially and spirally extend from about 20° to 75° around said shaft. The sets of long bristles are alternately spaced between said sets of short bristles to form from 3 to 8 rows of long bristles (preferably 6 rows) and from 3 to 8 rows of short bristles (preferably 6 rows).

DETAILED DESCRIPTION OF THE DRAWINGS

Generally speaking, the present invention features a mascara applicator device that selectively applies the mascara to the lashes of an eye, while simultaneously combing and separating the lashes to provide a natural lash appearance. The inventive applicator achieves the aforementioned result by means of an applicator brush that has alternating sets of long and short bristles, respectively. When the brush portion of the applicator is dipped into the reservoir or container of fluent mascara, the entire brush portion acquires the mascara. Upon the removal of the brush from the reservoir the brush is caused to pass through an orifice or wiper that removes the mascara fluent from the longer bristles, while retaining the mascara on the shorter bristles.

When the eyelashes are coated with mascara from the above-mentioned brush, the long bristles will comb and separate the lashes simultaneously while the shorter bristles apply the mascara fluent.

Figure 1:
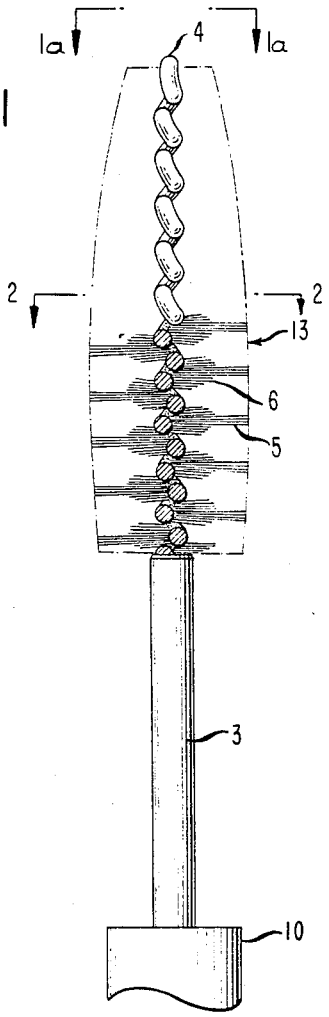
FIG. 1 illustrates an enlarged partial plan view of a mascara applicator having a tapered mascara brush characterized in this invention.
Figure 1A:
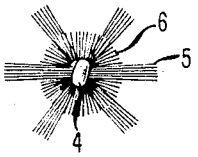
FIG. 1*a* is an end view of the mascara brush of FIG. 1, taken along line 1*a*—1*a*.
Figure 7:
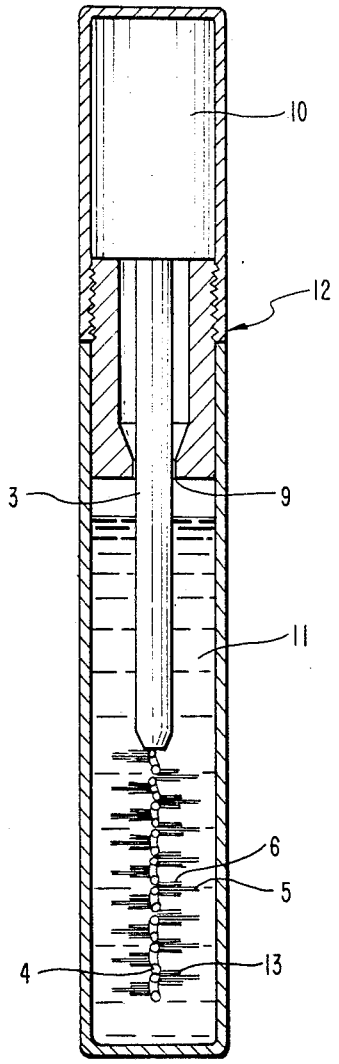
FIG. 7 illustrates an axial cross-sectional view of the entire mascara applicator device of this invention including the improved applicator shown in FIG. 1.

Referring to the cutaway FIG. 7, an axial sectional view of a mascara container 12 is illustrated containing fluent mascara 11 and characterized by the improved applicator brush 13 of the present invention, shown in more detail in FIG. 1. The applicator shaft 3 is attached to handle 10 at one end and contains brush 13 at the other end attached via wire 4. Brush 13 contains alternating rows of long and short bristles 5 and 6, respectively as shown in FIGS. 1 and 1*a*. A conventional wiper element or orifice 9, is included at mouth of the open end of the container 12 to remove the mascara 11. from the long bristles 5 while retaining the mascara on the shorter bristles 6.

FIG. 1 illustrates a longitudinally tapered mascara brush 13 wherein the bristles 5 and 6, respectively, are spirally attached along the applicator wire 4 at one end and a handle 10 is attached at an opposite end via shaft 3. The bristles 5 and 6 are grouped into alternating sets of long and short bristles 5 and 6, respectively.

FIG. 1*a* illustrates in an end view, taken along lines 1*a* of FIG. 1, the alternating rows of long bristles 5 and short bristles 6.

Figure 2:
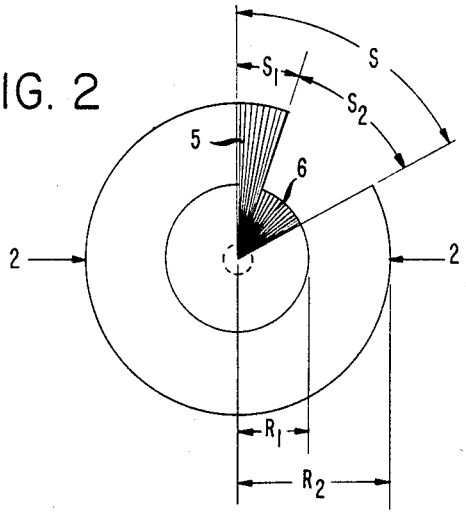
FIG. 2 is a partial, further enlarged cross-sectional view of the mascara brush of FIG. 1, taken along line 2—2.

In FIG. 2, a view taken along lines 2 of FIG. 1, the bristles are depicted in a typical group or set of alternating rows of long bristles 5, having radius $R_2$, and short bristles 6, having radius $R_1$, respectively. The radial segment formed by the row of short bristles is "$S_2$" and extends from about 20° to 75°. The radial segment formed by the row of long bristles is "$S_1$" and extends from about 20° to 75°. The combined radial segment formed by the alternating pair of both rows of long and short bristles is "S," and is merely the sum of "$S_1$" and "$S_2$." The preferred angle for either "$S_1$" or "$S_2$" is 30°.

Figure 3:
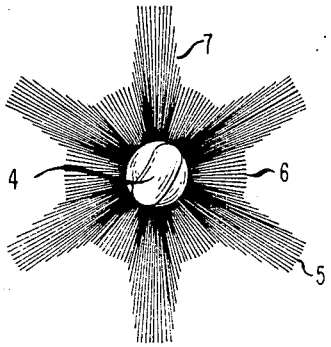
FIGS. 3, 4 and 5 illustrate alternative cross-sectional arrangements for the long and short bristles of the brush shown in FIG. 1.

FIG. 3 illustrates one particular arrangement of alternating rows of long bristles 5 and short bristles 6 around wire 4. The terminus of the long bristles 5 are side sheared to produce intermediate bristles 7 which allow for a gradual shortening from the long bristles 5 to the short bristles 6.

Figure 4:
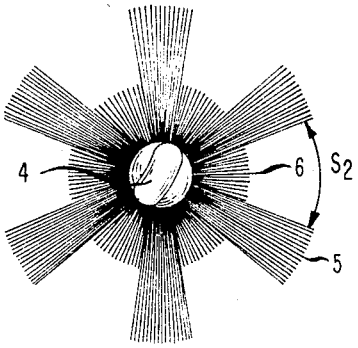

FIG. 4 illustrates an alternative arrangement of alternating rows of long bristles 5 and short bristles 6 around wire 4. The radial segment formed by the row of short bristles 6 is measured by angle $S_2$.

Figure 5:
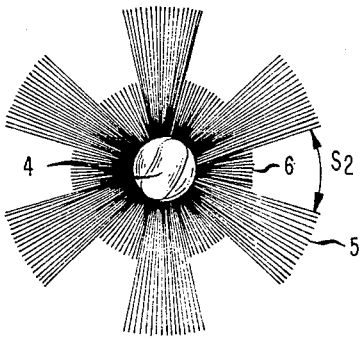

FIG. 5 illustrates another alternative arrangement of alternating rows of long bristles 5 and short bristles 6 around wire 4. The radial segment formed by the row of short bristles 6, measured by angle $S_2$ is diminished from that illustrated in FIG. 4.

Figure 6:
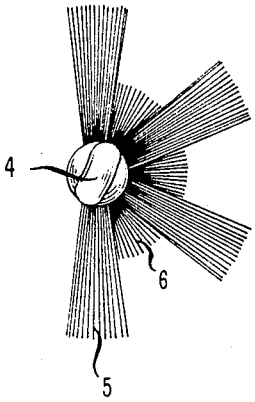
FIG. 6 illustrates an alternative embodiment wherein the alternating rows of relatively long and short bristles only partially circumscribe the wire of the applicator.

FIG. 6 illustrates a cross sectional view of an alternative embodiment of the present invention wherein the rows of long bristles 5 and short bristles 6 only partially circumscribe the applicator wire 4.

The radial length $R_2$ of the relatively long bristles in the mascara applicators of the present invention are characteristically about 0.125 inches to 0.375 inches while preferred long bristle lengths are 0.135 inches to 0.325 inches. The radial length $R_1$ of the relatively short bristles are characteristically about 0.125 inches to 0.185 inches while the preferred short bristles length is 0.135 inches to 0.160 inches.

The bristles may be placed either circumferentially or spirally around the wire 4. In either arrangement, the bristles are placed around the shaft to form rows of long and short bristles.

In one embodiment of the present invention, the long bristles are of uniform lengths throughout the rows as likewise are the short bristles. In another embodiment, the long and short bristles are gradually shortened from the handle end of the applicator to the tip of the applicator along the length of the rows to provide for a longitudinally tapered mascara brush 13. In still another embodiment, the long and short bristles are gradually shortened from the middle of the brush 13 and in both longitudinal directions to form a double tapered applicator brush.

In a preferred embodiment, the long bristles are gradually shortened from the middle of the brush and in both longitudinal directions to form a doubly tapered applicator, while the short bristles are of uniform length throughout.

In the preferred embodiment, the double tapering of the mascara bristles results in a gradual shortening of the long bristles along the axis of the brush at both ends of the brush. However, at any point the length of the long bristles is from 84 to 226% of the length of the short bristles. In this preferred embodiment, preferably, the length of the long bristles varies in relationship to the length of the short bristles.

In one embodiment of the present invention, there is a sharp demarcation between the groups of long and short bristles. In the preferred embodiment the bristles between the long and short longitudinal rows are gradually downwardly tapered from the long bristles to the short bristles, providing for bristles of intermediate length.

Preferably, 3 to 8 rows of long bristles and 3 to 8 rows of short bristles are employed.

Most preferably, 6 rows of long and 6 rows of short bristles are employed.

In one embodiment, the alternating rows of relatively short and long bristles only partially circumscribe the wire. In this embodiment, two to four rows of long bristles alternatively placed between two to four rows of short bristles are sufficient. However, in the preferred embodiment, the rows are placed completely around the wire.

Preferably, the length of rows are 0.750 inches to 1.00 inch with lengths of 0.775 inches to 0.825 inches being preferred.

The alternating rows of long and short bristles allow for facile application of mascara to the eyelashes. For example, by employing in the mouth of the reservoir a conventional wiper device which removes the mascara from the long bristles while retaining the mascara on the short bristles, a metered amount of mascara may be applied. Moreover, the short bristles, which hold this metered amount of mascara, apply the mascara to the eyelashes while the long bristles, which are now essentially free of mascara, simultaneously comb and separate the eyelashes.

By increasing or decreasing the distance of the radial segment of the rows of long and short bristles in different mascara applicators, mascara applicators can be tailored to hold and dispense a different amount of mascara.

In particular, this arrangement of alternating long and short bristles of this invention is especially suited for the adjustable mascara applicator disclosed in U.S. Pat. No. 3,998,235.

Having thus described this invention, what is desired to be protected by Letters Patent is presented in the following appended claims.

What is claimed is:

1. An applicator for selectively combing and applying fluent mascara to eyelashes, comprising:

an elongated applicator shaft having a handle portion disposed on one end thereof and a bristle brush portion disposed on an opposite end thereof, said brush portion including alternating sets of relatively long and short bristles of which approximately 10–50% are long bristles of about 0.125 inches to 0.375 inches in length and approximately 50–90% are short bristles of about 0.125 inches to 0.185 inches in length, said sets of long bristles extending from about 20° to 75° around said shaft and said sets of short bristles extending from about 20° to 75° around said shaft, said sets curcumferentially disposed substantially parallel to said shaft or spirally disposed about said shaft with said bristles radially extending outward therefrom;

a reservoir containing fluent mascara into which said brush portion of said applicator is dipped;

a cover removably engagable with said reservoir, forming at least part of said handle portion of said shaft; and a wiper means associated with said reservoir disposed at an inlet to said reservoir for removing essentially all fluent mascara from said sets of long bristles upon removal of said applicator from said reservoir while allowing fluent mascara to be retained on said short bristle sets;

wherein said sets of long bristles and said sets of short bristles are disposed about said shaft and are of a length sufficient to enable the wiper means to coact therewith to wipe the sets of long bristles essentially free of mascara and allow mascara to be retained on said sets of short bristles and to enable a user to selectively apply mascara with said sets of short bristles and to comb said eyelashes with the sets of long bristles.

2. The applicator of claim 1 wherein said sets of long bristles are alternately spaces between said sets of short bristles to form 6 circumferentially disposed rows of long bristles substantially parallel to said shaft and 6 circumferentially disposed rows of short bristles substantially parallel to said shaft.

3. The applicator of claim 1 wherein said sets of long bristles are alternately spaced between said sets of short bristles to form 6 spiral rows of long bristles and 6 spiral rows of short bristles.

4. The applicator of claim 1 wherein angles formed by the sets of spiral rows of long and short bristles measure approximately 30°.

5. The applicator of claim 1 wherein said alternating sets of long and short bristles extend in a continuous spiral around said applicator shaft.

6. The applicator of claim 1 wherein the long bristles are gradually shortened from a middle section of said brush portion along an axis of said shaft to form a dual tapered brush applicator while said short bristles are of uniform length along said shaft axis.

* * * * *